US008242399B2

(12) United States Patent
van Dijk et al.

(10) Patent No.: US 8,242,399 B2
(45) Date of Patent: Aug. 14, 2012

(54) OPERATING MECHANISM WITH ADJUSTMENT OF CONTACT FORCE

(75) Inventors: Marcel Berend Paul van Dijk, Enschede (NL); Gerhardus Leonardus Nitert, Hengelo (NL); Ronald Johannes Wilms, Hengelo (NL)

(73) Assignee: Eaton Electric B.V., Hengelo (NL)

( * ) Notice: Subject to any disclaimer, the term of this patent is extended or adjusted under 35 U.S.C. 154(b) by 1007 days.

(21) Appl. No.: 12/208,601

(22) Filed: Sep. 11, 2008

(65) Prior Publication Data

US 2009/0071811 A1 Mar. 19, 2009

(30) Foreign Application Priority Data

Sep. 13, 2007 (EP) ..... 07116375

(51) Int. Cl.
*H01H 5/00* (2006.01)

(52) U.S. Cl. ..... 200/400; 267/175; 200/251

(58) Field of Classification Search ..... 200/400, 200/401, 500, 501, 251, 286; 335/15, 192, 335/194; 267/175, 177
See application file for complete search history.

(56) References Cited

U.S. PATENT DOCUMENTS

| | | | | |
|---|---|---|---|---|
| 3,787,649 | A | 1/1974 | Goodwin, Jr. et al. | |
| 4,497,992 | A * | 2/1985 | Kodera et al. | 200/400 |
| 4,713,508 | A * | 12/1987 | Baginski et al. | 200/568 |
| 6,495,781 | B2 * | 12/2002 | Greenberg et al. | 200/308 |

FOREIGN PATENT DOCUMENTS

| | | |
|---|---|---|
| JP | 9161629 | 6/1997 |
| JP | 11040013 | 2/1999 |

* cited by examiner

*Primary Examiner* — Renee S Luebke
*Assistant Examiner* — Lheiren Mae Caroc
(74) *Attorney, Agent, or Firm* — Eckert Seamans Cherin & Mellott, LLC; Kirk D. Houser

(57) ABSTRACT

An operating mechanism operates a multi-pole circuit breaker assembly. For each circuit breaker in the multi-pole circuit breaker assembly, the following elements are provided: a connection assembly for connection to an operating shaft of the circuit breaker, an actuator for changing between an ON and OFF state of the operating mechanism, a translation assembly for transferring a movement of the actuator to the connection assembly, and a compression spring exerting a force on the operating shaft in the ON state of the operating mechanism. The force exerted by the compression spring is adjustable by a force setting assembly in a continuous manner.

20 Claims, 3 Drawing Sheets

OPERATING MECHANISM WITH ADJUSTMENT OF CONTACT FORCE

This application claims priority from European Regional patent application No. 07116375.2, filed Sep. 13, 2007, which is hereby incorporated by reference herein.

BACKGROUND OF THE INVENTION

1. Field of the Invention

The present invention relates to an operating mechanism for operating a multi-pole circuit breaker assembly, such as a medium voltage switchgear, comprising for each circuit breaker in the multi-pole circuit breaker assembly:

a connection assembly for connection to an operating shaft of the circuit breaker, an actuator for changing between an ON and OFF state of the operating mechanism, a translation assembly for transferring a movement of the actuator to the connection assembly, and a compression spring exerting a force on the operating shaft in the ON state of the operating mechanism the force exerted by the compression spring being adjustable by a force setting assembly in a continuous manner.

2. Background Information

Japanese patent publication JP-11-040013 describes an operating mechanism for a multi-pole circuit breaker. A connection is made between a swinging arm 4 and a link rod 60, using an elongated hole 65, pin 66 and pressure spring 6. The contact force seems to be adjustable using screws and bolts 61*a-c* in a continuous manner (using a screw thread).

Japanese patent application JP 9-161629 discloses a drive force transmitting device for use in co-operation with a circuit breaker. Two springs are provided, and the stroke can be adjusted using a hexagonal eccentric roller. The adjustment takes place with an opened electrode of the circuit breaker by rotation of the eccentric roller.

SUMMARY OF THE INVENTION

The present invention seeks to provide a more compact solution for the adjustment of an operating mechanism for circuit breakers, which allows easy and efficient adjustment of the contact force of the contacts of the circuit breaker.

According to the present invention, an operating mechanism according to the preamble defined above is provided, in which the force setting assembly comprises a spring holder with a spring holder top, the spring holder being in contact with one side of the compression spring, the spring holder top being connected to the translation assembly, the relative position of the spring holder and spring holder top being adjustable. E.g., the relative position of the spring holder and spring holder top is adjustable using a screw connection between the spring holder and spring holder top. This allows an easy and accurate setting of the mutual position of spring holder and spring holder top, and consequently of the force exerted on the circuit breaker contacts. By having a continuous adjustment capability, it is possible to more accurately set the force exerted on the contacts.

In a further embodiment, the spring holder top has an accession opening to allow mutual adjustment of the spring holder top and the spring holder. This allows easy access and adjustment, e.g. during assembly of the operating mechanism, when a cover of the operating mechanism is not yet installed. In a further embodiment, the spring holder is provided with at least one setting hole for adjusting the relative position between the spring holder and spring holder top using a setting tool. This setting tool can then be easily used when setting the intended force.

The relative position of the spring holder and spring holder top can be fixated using a locking device in a further embodiment, e.g. in the form of a locking screw. This assures the correct setting of the force exerted by the operating mechanism on the contact of the circuit breakers is maintained during the operational service life of the operating mechanism.

The spring holder comprises in a further embodiment a cylindrical body, the compression spring being positioned inside the cylindrical body. This allows for a compact structure of the operating mechanism.

The connection assembly comprises a spring guide connected to the operating shaft in a further embodiment, the compression spring being positioned around the spring guide and on the inside of the spring holder, a second side of the compression spring abutting a rim of the spring guide. Such a structure of the force setting assembly and connection assembly allows a very compact design of the operating mechanism, while maintaining the necessary operational characteristics needed for the operating mechanism (both for switching ON and OFF).

In a further embodiment, the operating mechanism comprises a drive plate connected to the actuator, and to each of the translation assemblies. In this manner it is assured that each circuit breaker of the multi-pole circuit breaker assembly is operated simultaneously using only a single actuator, which in turn allows to build a very compact operating mechanism.

The drive plate comprises an indicator tab for indicating the ON or OFF state of the operating mechanism in a further embodiment. This indicator tab e.g. co-operates with an opening in the cover of the operating mechanism to provide a visual indication of the state of the operating mechanism.

BRIEF DESCRIPTION OF THE DRAWINGS

The present invention will be discussed in more detail below, using a number of exemplary embodiments, with reference to the attached drawings, in which.

DESCRIPTION OF THE PREFERRED EMBODIMENTS

In medium voltage switchgear installations, it is of importance that (vacuum) circuit breakers (or switches) are operated in parallel simultaneously in each phase. One of the parameters influencing correct operation of the circuit breakers is the contact force in the ON position (i.e. the force exerted on the contacts of the circuit breaker when in contact), which should be substantially equal for all circuit breakers in a single three phase field of the installation.

Figure 1:
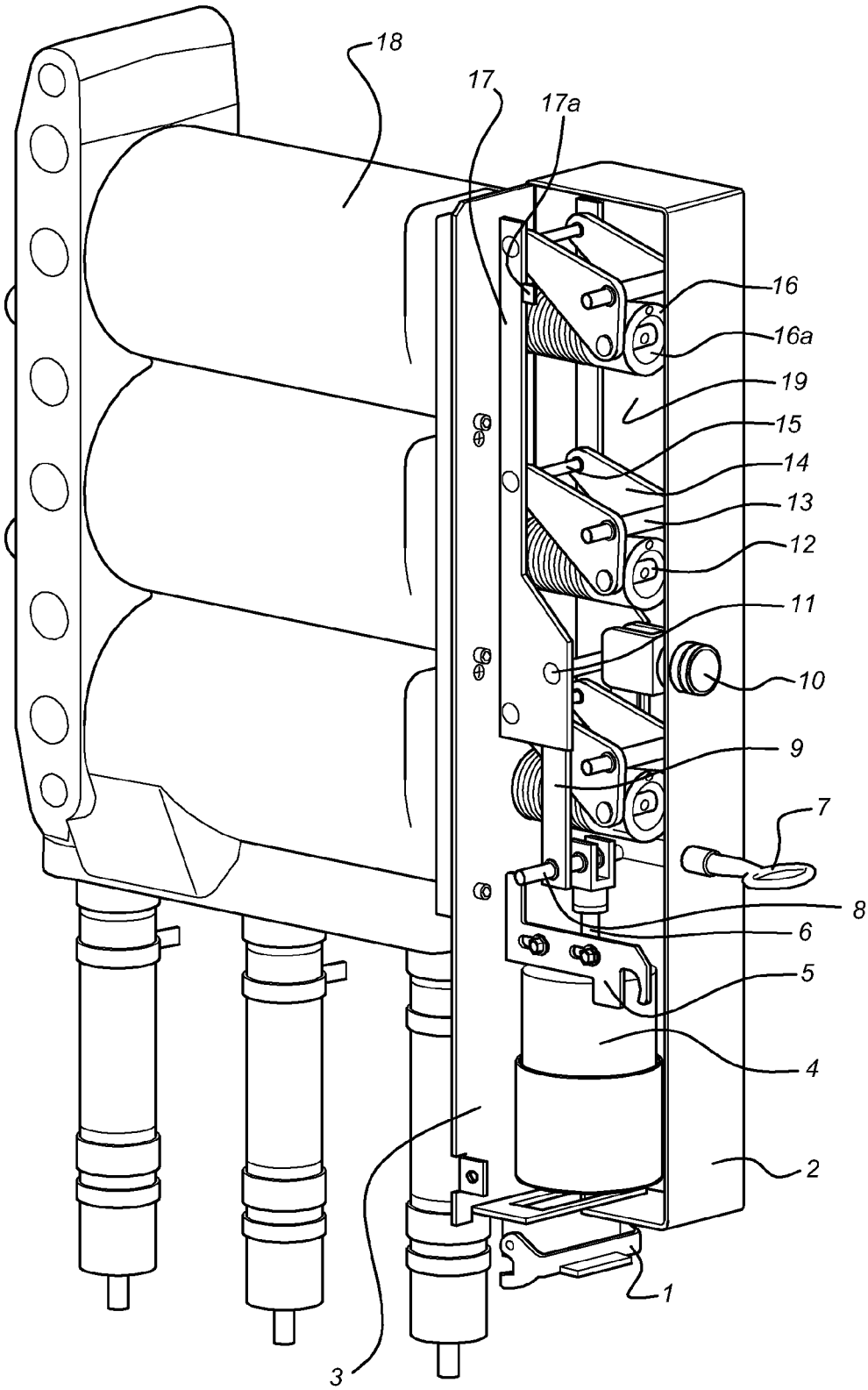
FIG. 1 shows a perspective view of an operating mechanism for circuit breakers in a three phase embodiment of the present invention.

An embodiment of a switchgear installation or circuit breaker assembly using an operating mechanism for opening and closing circuit breakers in three phases is shown in perspective in FIG. 1. In the installation three (vacuum) circuit breakers 18 are present, mounted in a rack, to which also feed lines are mounted. In front of the three vacuum circuit breakers 18, which are aligned parallel to each other, an operating mechanism is provided mounted on a bottom plate 3, which can be closed by a cover 2. The three-pole (or more generally, multi-pole) operating mechanism is suitable for operation of the vacuum circuit breakers 18 of the installation. The operating mechanism comprises a single actuator 4, e.g. an electromagnetic actuator, the structure and operation of which are known to the skilled person. The actuator 4 comprises a drive shaft 6, which can move between two positions for setting the operating mechanism in an ON or OFF state.

The drive shaft 6 is connected to a push strip 9 using a connecting shaft 8, which connecting shaft 8 is positioned perpendicular to the drive shaft 6 and extends a little further than the push strip 9. This allows a simple locking mechanism comprising a locking device 5 which can lock the installation in the ON position by blocking the downward movement of connecting shaft 8.

In the embodiment of the operating mechanism embodiment shown in FIG. 1, a key connection 7 is provided which extends through the cover plate 2, and which allows manual operation of the operating mechanism using a mechanical link, e.g. an eccentric actuating on the connecting shaft 8. The key connection 7 can be provided as an emergency OFF switch, e.g. for the case that no auxiliary power is available.

Furthermore, a push button 10 is provided in the cover plate 2, which is in electrical connection with the actuator 4, and is arranged to switch the actuator 4 from an ON position to an OFF position, and vice versa.

The push strip 9 is firmly connected to a drive plate 17, which in the embodiment shown comprises two parallel parts located at both sides of the vacuum circuit breaker 18 connections which extend through the bottom plate 3. The two parallel parts of drive plate 17 are held in a parallel construction using a number of interconnecting structures, such as a slider plug 11, shaft levers 15 (one for each phase), and the connecting shaft 8. The drive plate 17 moves in its longitudinal direction between an ON and an OFF position. In an alternative embodiment, the drive plate 17 may comprise a single part interconnected to the various structures of the operating mechanism.

The shaft lever 15 connects the drive plate 17 to a lever plate 14 in a pivoting manner, allowing the lever plate 14 and drive plate 17 to rotate with respect to each other. The lever plate 14 is also connected to a side plate 19 extending from or connected to the bottom plate 3 in a pivotable manner using a fixed shaft 13, and to a spring holder housing 16 using a shaft coupling 12.

The spring holder housing 16 is connected to an operation shaft 109 of the vacuum circuit breakers 18 (see the description of FIGS. 2 and 3 below), and provides a set force for operating the operation shaft 109 using a spring force (see also below for further details).

The shape of the lever plate 14, or more in particular, the distances and angles of the connecting lines between shaft lever 15 and fixed shaft 13, and between fixed shaft 13 and coupling shaft 12, respectively, result in a transformation of the up and down motion of the drive plate 17 in a direction parallel to the bottom plate 3 into an in and out motion of the spring holder housing 16 in a direction perpendicular to the bottom plate 3. This structure results in a very compact volume of the operating mechanism of the three pole operating mechanism. The elements described above form a translation assembly, which transfers the movement of the actuator 4 to the operating shaft 109.

In FIG. 1 it is shown that the drive plate 17 is provided with an indicator tab 17*a*. The side panel 19 may be provided with an indicator opening at a corresponding location, such that a visual indication may be provided of the state of the operating mechanism (ON or OFF) at the outside of the side plate 19. The side plates 19 and cover plate 2 may be combined in a single cover, provided that the fixed shafts 13 are then connected to the bottom plate 3.

Figure 2:
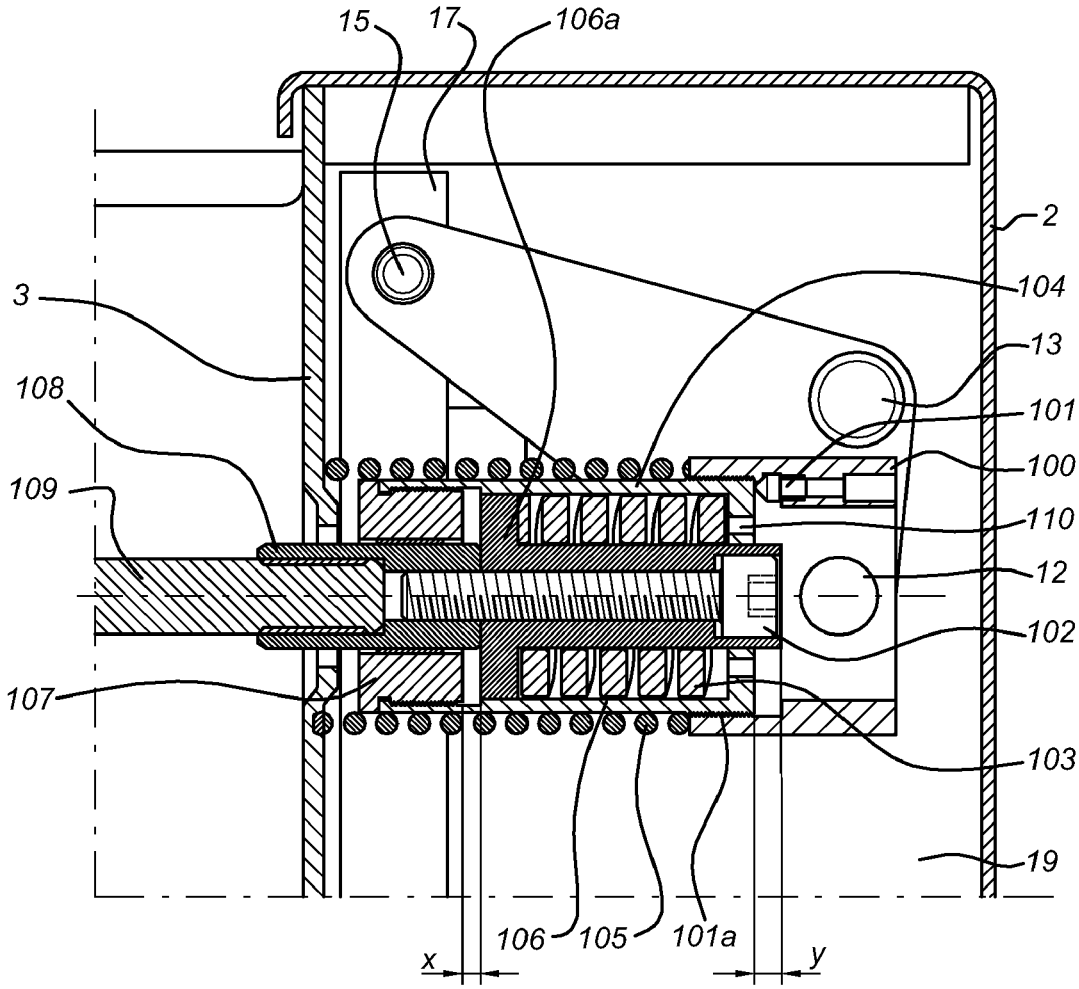
FIG. 2 shows a detailed cross sectional view of the spring holder housing of the embodiment of FIG. 1.

In a further embodiment, the drive plate 17 and/or lever plate 14 also actuate switches for the monitoring of the ON or OFF state. E.g. drive plate 17 actuates a make contact of a switch for ON state signalling. Lever plate 14 actuates a make contact of a switch for OFF state signalling (possibly provided in dual arrangement). The switches may be mounted on side panel 19. In FIG. 2, a detailed cross sectional view is shown of the spring holder housing of the embodiment shown in FIG. 1. The bottom plate 3, cover plate 2 and one side panel 19 is shown. The fixed shaft 13 is stationary with respect to this assembly of bottom plate 3, cover plate 2 and side panel 19, and allows the lever plate 14 to swivel around the fixed shaft 13 between an ON and an OFF position. The lever plate 14 is also attached to the drive plate 17 using a pivotable connection in the form of shaft lever 15. The lever plate 14 is connected to the shaft coupling 12 (see description of FIG. 1 above), which in turn is connected to a spring holder top 100.

In an alternative embodiment, the lever plate 14 is differently shaped, e.g. in the form of a knee plate connecting the drive plate 17 to the spring holder housing 16, in which the knee joint is fixed to the side plate 19 using the fixed shaft 13.

The spring holder top 100 is a part of a force setting assembly, and is connected to spring holder 104 using a screw connection, allowing a continuous adjustment of the relative position between the spring holder top 100 and spring holder 104. The spring holder 104 in this embodiment is a cylindrical body and holds a compression spring 103 internally against one side of the spring holder 104, and uses an end cover 107 screwed onto the other end of the spring holder 104. The compression spring 103 abuts on one end against the spring holder 104, and on the other end against a rim 106*a* of spring guide 106, around which the compression spring 103 is positioned. The spring guide 106 is connected to a top bush 108 using a bolt 102, which top bush 108 is attached to the insulating shaft 109, e.g. using a screw connection. The ensemble of spring guide 106, top bush 108 and bolt 102 may be regarded as forming a connection assembly, connecting the translation assembly to the insulating shaft 109. Between a rim of the spring holder top 100 and the bottom plate 3, a compensation spring 105 is positioned, on the outside of spring holder 104 and co-axial to the compression spring 103.

In the ON position, as shown in FIG. 2, the spring holder 104 has moved towards the bottom plate 3, but a little bit further than the actual movement of the insulating shaft 109 needs to move to have the contacts of the vacuum circuit breaker 18 make physical contact. In the ON position, a gap of a distance X is present between the right surface of end cover 107 and the left surface of a rim 106*a* of the spring guide 106 as indicated in FIG. 2. As a result, the compression spring 103 exerts a force on the spring guide 106, and thus on insulating shaft 109, which in turn leads to a force being exerted on the contacts of the vacuum circuit breaker 18.

The distance X can also be said to be present between spring holder 104 and spring guide 106, at suitable reference points.

When operating the operating mechanism towards the OFF position, the spring holder 104 only starts moving when the rim 106*a* of spring guide 106 is in mechanical contact with the spring holder 104 (or in the embodiment shown, with end cover 107). Thus, the contacts of the vacuum circuit breaker are moved from one another by a sudden forced impulse. The movement of the spring holder 104 towards the OFF position is assisted by compensation spring 105.

Figure 3:
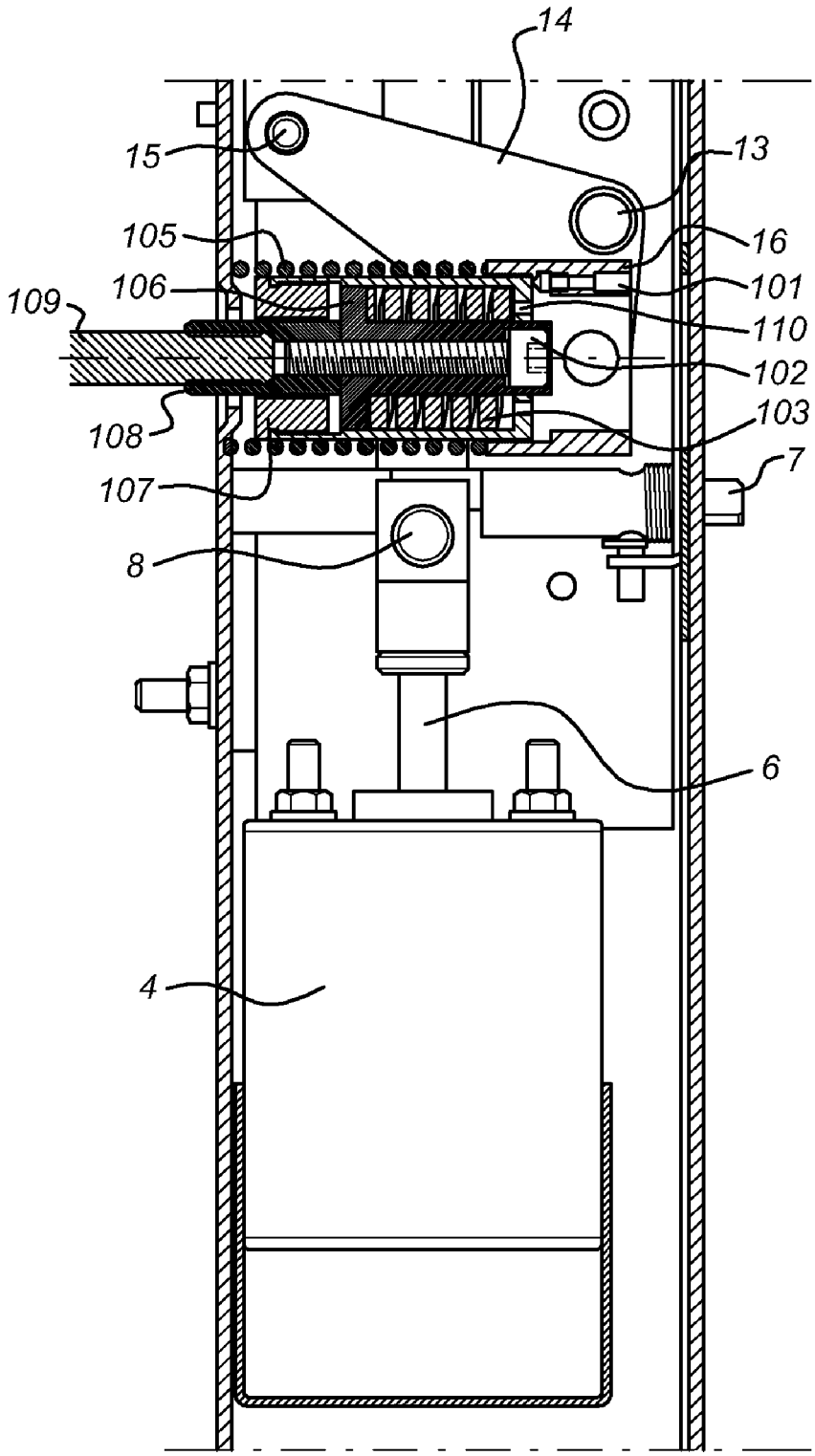
FIG. 3 shows a cross sectional view of a lower part of the operating mechanism embodiment of FIG. 1.

In FIG. 3, a cross sectional view is shown of the lower part of the operating mechanism as shown in the embodiment of FIG. 1, again in the ON position. Also in this case, the distance X is indicated. The actual distance X can be measured and should be equal to a predetermined, fixed value, to ensure a sufficiently high force is exerted on the contacts of the vacuum circuit breaker 18 in the ON position. When the three pole operating mechanism as shown in the embodiment of FIGS. 1-3 is assembled up to the cover plate 2, the contact force can be set in a very efficient, variable and ergonomic manner. In the ON position of the operating mechanism, the distance X is directly measured between the surface of the spring guide 106 and the surface of the end cover 107 (see description of FIG. 2 above). This direct measurement can be done when the spring holder is provided with measurement slits at the location of the measurement. The difference between the measured value of distance X and the predetermined, fixed value is an indication how far the spring holder 104 should be turned out (or in) of the spring holder top 100.

In an alternative manner, the distance X may be measured (indirectly) from the front side of the mechanism, using the more easily accessible parts of the mechanism, i.e. top of spring holder 104 and top of spring guide 106 (or bolt 102). In this case, the distance Y as indicated in FIG. 2 and FIG. 3 is measured in the ON position and in the OFF position, and the distance X is then the difference between these two measurements ($X=Y_1-Y_2$).

Adjustment can be easily accomplished when the operating mechanism is returned to the OFF position, from the front side of the operating mechanism, as the spring holder 104 and spring holder top 100 can be easily turned or adjusted. As no contact force is present in the system, the friction on the screw thread of spring holder 104 and spring holder top 100 is very low. The spring holder top 100 is furthermore provides with an accession opening 16*a* (see FIG. 1) which further aids in accessibility. In the embodiment shown, multiple setting holes 110 are provided, such that with the use of a special tool, the spring holder 104 can be turned with respect to the spring holder top 100.

After that, the operating mechanism can be brought back to the ON position, and the distance X between spring holder 104 and spring guide 106 can be measured for verification. If the measured value corresponds to the predetermined, fixed value, the contact force set up can be fixated using a locking device, such as a locking screw set 101 as shown in the embodiment of FIGS. 2 and 3.

Nowadays, springs like compression spring 103 and compensation spring 105 may be manufactured with precisely defined spring constants (within certain margins). The present invention allows to indirectly measure the force exerted on the circuit breaker 18 contacts in the ON position, by measuring a distance and comparing this with a predetermined, fixed value as derived from the spring constants of compression spring 103 and compensation spring 105.

The invention claimed is:

1. Operating mechanism for operating a multi-pole circuit breaker assembly, comprising for each circuit breaker in the multi-pole circuit breaker assembly:

a connection assembly for connection to an operating shaft of the circuit breaker, an actuator for changing between an ON and OFF state of the operating mechanism, a translation assembly for transferring a movement of the actuator to the connection assembly, and a compression spring exerting a force on the operating shaft in the ON state of the operating mechanism, the force exerted by the compression spring being adjustable by a force setting assembly in a continuous manner, in which the force setting assembly comprises a spring holder with a spring holder top, the spring holder being in contact with one side of the compression spring, the spring holder top being connected to the translation assembly, the relative position of the spring holder and spring holder top being adjustable.

2. Operating mechanism according to claim 1, in which the relative position of the spring holder and spring holder top is adjustable using a screw connection between the spring holder and spring holder top.

3. Operating mechanism according to claim 2, in which the spring holder top has an accession opening to allow mutual adjustment of the spring holder top and the spring holder.

4. Operating mechanism according to claim 2, the spring holder is provided with at least one setting hole for adjusting the relative position between the spring holder and spring holder top using a setting tool.

5. Operating mechanism according to claim 2, in which the relative position of the spring holder and spring holder top can be fixated using a locking device.

6. Operating mechanism according to claim 2, in which the spring holder comprises a cylindrical body, the compression spring being positioned inside the cylindrical body.

7. Operating mechanism according to claim 2, in which the operating mechanism comprises a drive plate connected to the actuator, and to each of the translation assemblies.

8. Operating mechanism according to claim 1, in which the spring holder top has an accession opening to allow mutual adjustment of the spring holder top and the spring holder.

9. Operating mechanism according to claim 8, the spring holder is provided with at least one setting hole for adjusting the relative position between the spring holder and spring holder top using a setting tool.

10. Operating mechanism according to claim 8, in which the relative position of the spring holder and spring holder top can be fixated using a locking device.

11. Operating mechanism according to claim 8, in which the spring holder comprises a cylindrical body, the compression spring being positioned inside the cylindrical body.

12. Operating mechanism according to claim 1, the spring holder is provided with at least one setting hole for adjusting the relative position between the spring holder and spring holder top using a setting tool.

13. Operating mechanism according to claim 12, in which the relative position of the spring holder and spring holder top can be fixated using a locking device.

14. Operating mechanism according to claim 12, in which the spring holder comprises a cylindrical body, the compression spring being positioned inside the cylindrical body.

15. Operating mechanism according to claim 1, in which the relative position of the spring holder and spring holder top can be fixated using a locking device.

16. Operating mechanism according to claim 15, in which the spring holder comprises a cylindrical body, the compression spring being positioned inside the cylindrical body.

17. Operating mechanism according to claim 1, in which the spring holder comprises a cylindrical body, the compression spring being positioned inside the cylindrical body.

18. Operating mechanism according to claim 17, in which the connection assembly comprises a spring guide connected to the operating shaft, the compression spring being positioned around the spring guide and on the inside of the spring holder, a second side of the compression spring abutting a rim of the spring guide.

19. Operating mechanism according to claim 1, in which the operating mechanism comprises a drive plate connected to the actuator, and to each of the translation assemblies.

20. Operating mechanism according to claim 19, in which the drive plate comprises an indicator tab for indicating the ON or OFF state of the operating mechanism.

* * * * *